US012551031B2

(12) United States Patent
Smedley

(10) Patent No.: US 12,551,031 B2
(45) **Date of Patent: *Feb. 17, 2026**

(54) RETAIL MERCHANDISE SHELVING SYSTEM AND DECK PANELS FOR SAME

(71) Applicant: Fasteners for Retail, Inc., Twinsburg, OH (US)

(72) Inventor: Jamie A. Smedley, Hudson, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/760,900

(22) Filed: Jul. 1, 2024

(65) Prior Publication Data

US 2024/0349913 A1 Oct. 24, 2024

Related U.S. Application Data

(63) Continuation of application No. 17/308,775, filed on May 5, 2021, now Pat. No. 12,053,106.

(60) Provisional application No. 63/031,344, filed on May 28, 2020.

(51) Int. Cl.
*A47F 5/00* (2006.01)
*A47B 96/02* (2006.01)

(52) U.S. Cl.
CPC ..... *A47F 5/0043* (2013.01); *A47B 96/021* (2013.01); *A47B 96/028* (2013.01); *A47F 5/0018* (2013.01)

(58) Field of Classification Search
CPC .... A47F 5/0043; A47F 5/0018; A47B 96/021; A47B 96/028
See application file for complete search history.

(56) References Cited

U.S. PATENT DOCUMENTS

| | | | |
|---|---|---|---|
| 1,354,270 | A | 9/1920 | Wood |
| 1,677,764 | A | 7/1928 | Gloekler |
| 2,091,599 | A | 8/1937 | Larson et al. |
| 2,191,701 | A | 2/1940 | Wood |
| 2,305,244 | A | 12/1942 | Erickson |
| 2,633,998 | A | 4/1953 | Henrietta et al. |
| 2,790,559 | A | 4/1957 | Stephenson et al. |
| 2,933,195 | A | 4/1960 | Radek |
| 2,940,601 | A | 6/1960 | Smith |
| 2,975,908 | A | 3/1961 | Huet |
| 3,082,880 | A | 3/1963 | Mapson |

(Continued)

FOREIGN PATENT DOCUMENTS

| | | | |
|---|---|---|---|
| CA | 1037908 | A | 9/1978 |
| CA | 2725928 | A1 | 6/2011 |

(Continued)

*Primary Examiner* — Stanton L Krycinski
(74) *Attorney, Agent, or Firm* — Reinhart Boerner Van Deuren P.C.

(57) ABSTRACT

A deck panel for a retail shelving system is provided. The deck panel includes a panel and a region of strengthening ribbing. The panel has a top surface configured for supporting retail merchandise and a bottom surface. The region of strengthening ribbing includes a plurality of ribs extending outward from the bottom surface of the panel. The bottom surface of the panel has a border region that extends around the region of strengthening ribbing on at least three sides. The deck panel may be part of a shelf which may be part of a shelving system.

21 Claims, 10 Drawing Sheets

(56) References Cited

U.S. PATENT DOCUMENTS 3,185,426 A 5/1965 Bjerke
3,196,812 A 7/1965 Jacques
3,225,940 A 12/1965 Story
3,237,779 A 3/1966 Eger
3,285,428 A 11/1966 Scheck
3,297,374 A 1/1967 Radek
3,298,503 A 1/1967 Field et al.
3,302,800 A 2/1967 Zdanowski
3,358,847 A 12/1967 Magnuson
3,403,787 A 10/1968 Browning
D214,923 S 8/1969 Schier
3,465,891 A 9/1969 Rose
3,556,306 A 1/1971 Shell
3,610,427 A 10/1971 Maziarka et al.
3,733,755 A 5/1973 Butler
3,827,574 A 8/1974 Craig, Sr.
3,832,957 A 9/1974 Mendenhall
3,965,826 A 6/1976 Markham
3,986,462 A 10/1976 Heft
4,018,167 A 4/1977 Spangler
4,078,664 A 3/1978 McConnell
4,081,880 A 4/1978 Edeus
4,098,480 A 7/1978 Neumann
4,118,087 A 10/1978 Dorf
4,250,679 A 2/1981 Burg
4,431,155 A 2/1984 Engel
4,455,007 A 6/1984 Varon et al.
4,467,927 A 8/1984 Nathan
4,540,222 A 9/1985 Burrell
4,665,838 A 5/1987 Minshall
4,760,930 A 8/1988 Fox
4,785,945 A 11/1988 Rowse et al.
4,815,394 A 3/1989 Ettlinger et al.
4,874,148 A 10/1989 Guinter
4,955,490 A 9/1990 Schäfer
5,110,080 A 5/1992 Rieman
5,158,187 A 10/1992 Taub
5,253,837 A 10/1993 Loux
5,257,701 A 11/1993 Edelson
5,277,393 A 1/1994 Nicholson et al.
5,279,431 A 1/1994 Highsmith et al.
5,310,066 A 5/1994 Konstant
5,313,891 A 5/1994 Suttles
5,356,106 A 10/1994 Trotta et al.
5,433,152 A 7/1995 Henry
5,529,192 A 6/1996 Conen et al.
5,628,415 A 5/1997 Mulholland
5,638,644 A 6/1997 Bastian
5,709,158 A 1/1998 Wareheim
5,738,019 A 4/1998 Parker
5,769,247 A 6/1998 Merl
5,893,470 A 4/1999 Peggs
5,921,411 A 7/1999 Merl
5,964,163 A 10/1999 Cohen
6,006,926 A 12/1999 O'Reilly et al.
6,021,908 A 2/2000 Mathews
6,105,798 A 8/2000 Gruber et al.
6,168,032 B1 1/2001 Merl
6,234,328 B1 5/2001 Mason
6,257,425 B1 7/2001 Liu
6,257,427 B1 7/2001 Schneid
6,401,945 B1 6/2002 Gawel
6,405,557 B1 6/2002 DeCastro et al.
6,669,154 B1 12/2003 Remmers
6,705,477 B1 3/2004 Narkis et al.
D490,697 S 6/2004 Runnalls
6,820,757 B2 11/2004 Craft et al.
6,892,993 B2 5/2005 Palmer
6,962,116 B2 11/2005 Bieniek et al.
D526,887 S 8/2006 Remmers et al.
7,086,544 B1 8/2006 Doench
7,131,547 B2 11/2006 Gawel
7,150,364 B2 12/2006 Jablow et al.
D543,094 S 5/2007 Remmers
7,225,935 B2 6/2007 Breymaier et al.
7,300,122 B2 11/2007 Vardon
7,347,336 B1 3/2008 Williams et al.
7,478,731 B1 1/2009 Mason
7,497,344 B2 3/2009 Chen
7,644,827 B2 1/2010 Hanretty
7,654,497 B1 2/2010 Karan
7,784,413 B2 8/2010 Gabriel et al.
7,810,487 B2 10/2010 Johnston
8,087,522 B2 1/2012 Stafford et al.
8,141,723 B2 3/2012 Whalen et al.
8,434,629 B2 5/2013 Fernandez
8,517,191 B2 8/2013 Paeth
8,627,966 B2 1/2014 Jarvis et al.
8,657,130 B2 2/2014 Thrush et al.
8,899,162 B2 12/2014 Chikkakalbalu
8,905,248 B1 12/2014 Wolski
8,985,350 B2 3/2015 Thrush et al.
8,998,009 B2 4/2015 Kim et al.
9,027,767 B2 5/2015 Buckley et al.
9,119,471 B2 9/2015 Gonzalez et al.
9,289,065 B1 3/2016 Lambertson
9,375,102 B2 6/2016 Troyner et al.
9,445,669 B2 9/2016 Li et al.
9,468,312 B2 10/2016 Denby
9,474,374 B2 10/2016 Reinhart
9,486,090 B2 11/2016 Juric
9,532,662 B2 1/2017 Desmond
9,538,846 B2 1/2017 Reinhart et al.
9,538,859 B1 1/2017 Johnson et al.
9,578,976 B2 2/2017 Grubbs et al.
D803,671 S 11/2017 Neelagantan et al.
9,877,600 B1 1/2018 Lin
10,021,972 B1 7/2018 Robinson et al.
10,051,959 B1 8/2018 Glidewell
10,123,617 B2 11/2018 Rollins et al.
10,123,637 B1 11/2018 DeSena et al.
10,182,652 B1 1/2019 Spielmann et al.
10,206,506 B1 2/2019 Lai et al.
10,213,016 B2 2/2019 Bellar et al.
10,231,544 B2 3/2019 Reinhart
10,334,970 B2 7/2019 Buck et al.
D875,448 S 2/2020 Reinhart et al.
10,638,856 B2 5/2020 Nagel et al.
10,709,237 B2 7/2020 Robinson et al.
10,709,238 B1 7/2020 Thompson
10,905,239 B2 2/2021 Newman
11,246,396 B2 2/2022 Boos
11,268,284 B2 3/2022 Ohrstrom
11,304,546 B1 4/2022 Boos
11,350,743 B2 6/2022 Reinhart et al.
11,389,015 B2 7/2022 Smedley et al.
11,583,110 B2 2/2023 Smedley et al.
11,612,245 B2 * 3/2023 Meiser ..... A47B 96/021
211/134
12,053,106 B2 8/2024 Smedley
2001/0050262 A1 12/2001 LaBruna, Jr. et al.
2003/0132182 A1 7/2003 Jay
2003/0159344 A1 8/2003 Vandewiele et al.
2004/0159622 A1 8/2004 Craft et al.
2004/0182804 A1 9/2004 Harper
2005/0127017 A1 6/2005 Kessel et al.
2005/0263465 A1 12/2005 Chung
2006/0011568 A1 1/2006 Remmers et al.
2007/0119798 A1 5/2007 Hanretty
2007/0221103 A1 9/2007 Trausch
2008/0272076 A1 11/2008 Davenport
2009/0107941 A1 4/2009 Liao
2009/0223912 A1 9/2009 Chen
2009/0308290 A1 12/2009 Bohnacker
2010/0065523 A1 3/2010 Northrup, Jr. et al.
2010/0116760 A1 5/2010 Fazzone
2010/0133219 A1 6/2010 Sun
2010/0213334 A1 8/2010 Davenport
2010/0224582 A1 9/2010 Loy, II et al.
2010/0300999 A1 12/2010 Schwartzkopf et al.
2011/0147323 A1 6/2011 Sainato et al.
2011/0155677 A1 6/2011 Fernandez et al.
2011/0204014 A1 8/2011 Miller et al.
2012/0018392 A1 1/2012 Peota et al.

(56) References Cited

U.S. PATENT DOCUMENTS

| | | | |
|---|---|---|---|
| 2012/0084961 | A1 | 4/2012 | Stafford et al. |
| 2012/0285915 | A1 | 11/2012 | O'Quinn et al. |
| 2014/0034591 | A1 | 2/2014 | Szpak et al. |
| 2014/0263128 | A1 | 9/2014 | Garrett et al. |
| 2015/0027972 | A1 | 1/2015 | Andersson et al. |
| 2015/0173528 | A1 | 6/2015 | Hester-Redmond |
| 2016/0106235 | A1 | 4/2016 | Mason |
| 2017/0071364 | A1 | 3/2017 | Turner et al. |
| 2017/0202368 | A1 | 7/2017 | Bird et al. |
| 2018/0132611 | A1 | 5/2018 | Lu et al. |
| 2018/0153313 | A1 | 6/2018 | Padvoiskis et al. |
| 2018/0153316 | A1 | 6/2018 | Buck et al. |
| 2018/0360211 | A1 | 12/2018 | Lu et al. |
| 2018/0360236 | A1 | 12/2018 | Kim et al. |
| 2019/0116977 | A1 | 4/2019 | Lindblom et al. |
| 2019/0387902 | A1 | 12/2019 | Peck et al. |
| 2020/0139664 | A1 | 5/2020 | Ohara et al. |
| 2020/0187675 | A1 | 6/2020 | Obitts et al. |
| 2021/0199490 | A1 | 7/2021 | Fritsch et al. |
| 2021/0330081 | A1 | 10/2021 | McMillin et al. |
| 2022/0031070 | A1 | 2/2022 | Brunner et al. |
| 2022/0160124 | A1 | 5/2022 | Hollis |
| 2022/0287480 | A1 | 9/2022 | Obitts et al. |
| 2023/0147456 | A1 | 5/2023 | Smedley et al. |
| 2024/0268579 | A1 | 8/2024 | Smedley et al. |

FOREIGN PATENT DOCUMENTS

| | | | |
|---|---|---|---|
| CN | 2480510 | Y | 3/2002 |
| CN | 1655705 | A | 8/2005 |
| CN | 104433528 | A | 3/2015 |
| CN | 108477884 | A | 9/2018 |
| CN | 207848127 | U | 9/2018 |
| CN | 207921581 | U | 9/2018 |
| CN | 108703590 | A | 10/2018 |
| CN | 108884848 | A | 11/2018 |
| DE | 9420293 | U1 | 2/1995 |
| DE | 29621679 | U1 | 2/1997 |
| DE | 29802700 | U1 | 5/1998 |
| DE | 202011002872 | U1 | 7/2011 |
| DE | 202018005669 | U1 | 4/2019 |
| DE | 102018108923 | A1 | 10/2019 |
| DE | 202019003006 | U1 | 10/2019 |
| DE | 202018003945 | U1 | 1/2020 |
| DE | 202019103867 | U1 | 11/2020 |
| FR | 2906694 | A1 | 4/2008 |
| FR | 2988279 | A1 | 9/2013 |
| JP | 2014212874 | A | 11/2014 |
| KR | 20070107919 | A | 11/2007 |
| KR | 20070109517 | A | 11/2007 |
| WO | WO 01/34006 | A1 | 5/2001 |
| WO | WO 2003/063646 | A2 | 8/2003 |
| WO | WO 2012032517 | A1 | 3/2012 |
| WO | WO 2019145948 | A1 | 8/2019 |

* cited by examiner

RETAIL MERCHANDISE SHELVING SYSTEM AND DECK PANELS FOR SAME

CROSS-REFERENCE TO RELATED PATENT APPLICATIONS

This Patent Application is a Continuation of U.S. patent application Ser. No. 17/308,775, filed May 5, 2021, which is now pending. This Patent Application claims the benefit of U.S. Provisional Patent Application No. 63/031,344, filed May 28, 2020, the entire teachings and disclosure each of which are incorporated herein by reference thereto.

FIELD OF THE INVENTION

This invention generally relates to retail displays, and more particularly to retail shelving systems.

BACKGROUND OF THE INVENTION

Retail shelving is a staple in the retail merchandise environment. While such shelving comes in many forms, it generally includes a vertical support structure which supports one or more shelves extending outwardly from the vertical structure. The vertical structure is typically a wall-like structure and contains integrated mounting rails, referred to in in the industry as gondola uprights, to which the shelves.

The shelves of such shelving systems present several drawbacks. These shelves are typically steel structures which can corrode over time and which are heavy making them difficult to remove for cleaning. One alternative has been to utilize aluminum shelving instead, but this material results in a more costly system. Also, such steel or aluminum shelves do not meet the requirements for NSF Certification by NSF International, which is a highly desired certification in certain retail display applications in which the shelving surface comes into direct contact with the product being merchandised.

Examples of the present application provide improvements over the current state of the art as it relates to retail shelving systems.

BRIEF SUMMARY OF THE INVENTION

In one example, a deck panel for a retail shelving system is provided. The deck panel is used to support merchandise. The deck panel includes a panel and a region of strengthening ribbing. The panel has a top surface configured for supporting retail merchandise and a bottom surface. The region of strengthening ribbing includes a plurality of ribs extending outward from the bottom surface of the panel. The bottom surface of the panel has a border region that extends around the region of strengthening ribbing on at least three sides.

In a particular example, the border region is substantially flat (e.g. projections that are greater than 25% of the thickness of the panel are not present extending from the border region.

In an example, the panel has a front edge, a rear edge and a pair of side edges extending between the front edge and the rear edge. The border region extends along the pair of side edges and the rear edge.

In an example, the border region has a thickness measured perpendicular to the bottom surface. The plurality of ribs extending outward from the bottom surface have an average height that is measured perpendicular to the bottom surface. The average height is at least five times the thickness.

In an example, the border region is free of projections.

In an example, the border region includes apertures extending entirely through a thickness of the border region (e.g. through the top and bottom surfaces).

In an example, the front edge is provided by a vertical wall that extends outward beyond the top surface and outward beyond the bottom surface.

In an example, a plurality of the plurality of ribs are all interconnected with one another and interconnected with the vertical wall.

In an example, a first portion of the border region extends between the vertical wall and the rear edge along one of the pair of side edges. A second portion of the border region extends between the pair of side edges along the rear edge. A third portion of the border region extends between the vertical wall and the rear edge along the other one of the pair of side edges.

In an example, the border region is free of projections.

In an example, the panel has a generally rectangular periphery. The region of strengthening ribbing may optionally have a rectangular periphery as well.

In an example, the region of strengthening ribbing has an outer periphery that includes pair of opposed sides and a rear side. These sides may be provided by outer most ribs extending outward from the bottom surface (e.g. generally perpendicular-plus/minus 15 degrees). The opposed sides are generally parallel. The rear side is generally perpendicular to the sides of the pair of opposed sides. The pair of opposed sides is parallel to and spaced inward from the pair side edges and the rear side is parallel to and spaced inward from the rear edge.

In an example, the border region is free of projections or apertures in the portion thereof extending along the rear edge.

In an example, the panel includes a plurality of apertures extending through the top and bottom surfaces. The ribs do not extend across any of the apertures such that the ribs do not have a portion of an aperture on one side of the rib and apportion of the same aperture on the other side of the rib. The ribs may be immediately adjacent apertures.

In another example, a shelf is provided. The shelf includes first and second support arms, front and rear support bars and a deck panel as outlined above. The first and second support arms are arranged in opposed lateral spaced relation to one another. The front and rear support bars extend laterally between the first and second support arms. The deck panel is supported by the front and rear support bars. The border region extends over the first and second support arms. The region of strengthening ribbing is positioned laterally between the first and second support arms.

In another example, a shelf is provided. The shelf includes first and second support arms, front and rear support bars and a deck panel. The first and second support arms are arranged in opposed lateral spaced relation to one another. The front and rear support bars extend laterally between the first and second support arms. The deck panel is supported by the front and rear support bars. The deck panel includes a panel having a top surface configured for supporting retail merchandise and a bottom surface. The deck panel includes a region of strengthening ribbing including a plurality of ribs extending outward from the bottom surface of the panel. The bottom surface has a border region that extends around the region of strengthening ribbing on at least three sides. The border region extends over the first and second support arms.

The region of strengthening ribbing being positioned laterally between the first and second support arms.

In an example, the portion of the border region that extends over the first support arm is unitarily formed as a single piece with the portion of the border region that extends over the second support arm.

In an example, the border region extends laterally outward beyond the first and second support arms.

In an example, the region of strengthening ribbing includes a front channel and a rear channel. The front support bar is received in the front channel and the rear support bar is received in the rear channel.

In an example, for each of the front and rear channels, a bottom thereof is defined by short rib regions. The top of the front and rear support bars abut the short rib regions.

In an example, each of the first and second support arms has a top surface. The border region is vertically spaced from the top surface of the first and second support arms. A gap may be formed therebetween.

In an example, the shelf includes a single deck panel extending laterally beyond both of the first and second support arms and being supported by the front and rear support bars.

In an example, the deck panel includes resilient finger tabs that snap engage the deck panel to at least one of the front and rear support bars.

In another example, a shelving system including a deck panel or shelf as outlined above is provided. The shelving system includes a pair of upright supports. Each upright support has an upper end and a lower end. Each upright support has a plurality of apertures mounting the first and second support arms thereto.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
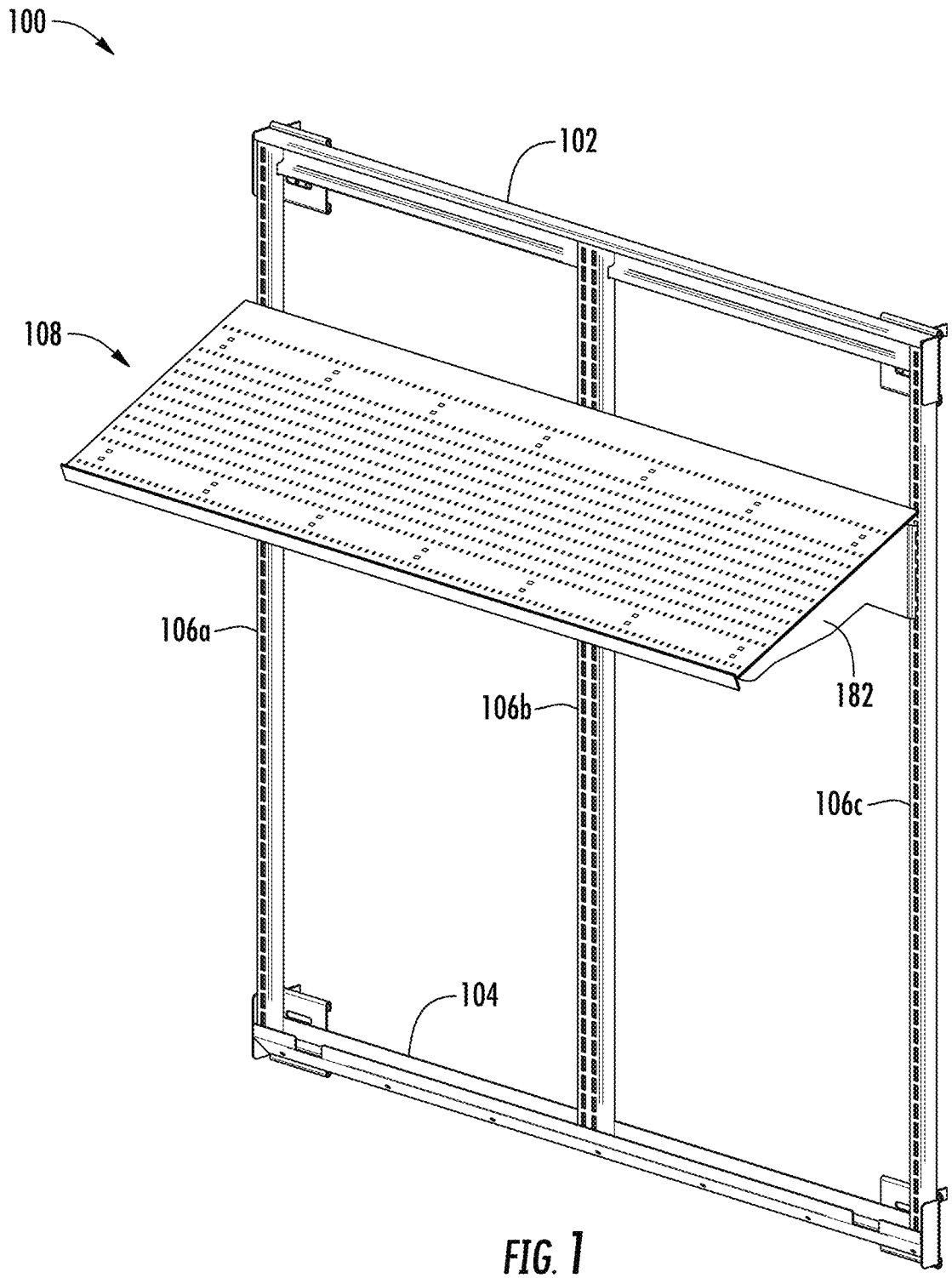
FIG. 1 is a perspective view of an exemplary embodiment of a retail shelving system according to the teachings herein.

With specific reference now to FIG. 1, the same illustrates an exemplary embodiment of a shelving system 100 according to the teachings herein. Shelving system 100 includes a grid assembly with one or more shelves 108 mounted thereto. While one shelf 108 is shown, it is contemplated that any number of shelves may be mounted to this grid assembly. Further, while shelf 108 illustrated the full length of the grid assembly, shorter shelf lengths are entirely possible.

The grid assembly itself may be that as previously disclosed in U.S. patent application Ser. No. 16/222,722, filed Dec. 17, 2018, entitled "Retail Shelving System," the teachings and disclosures of which are incorporated herein by reference thereto.

The grid assembly includes an upper rail 102 and a separate lower rail 104. Upper and lower rails 102, 104 are configured to mount to a support structure such as a vertical wall, the interior of a refrigerated or freezer case, etc. Indeed, upper and lower rails 102, 104 may be adapted to mount to any structure capable of supporting the same. As such, upper and lower rails 102, 104 may incorporate any mounting expedient, including screws, bolts, pins, hooks, ledges, etc.

In the illustrated embodiment, the upper and lower rails 102, 104 are separate components. As a result, they may be separately installed to the aforementioned support structure. This makes installation simpler than in prior designs which require lifting a large welded grid structure as a single unit and installing it in place on a support structure.

A plurality of upright supports 106*a*, 106*b*, 106*c* are slidably received in upper and lower rails 102, 104. Upright supports 106*a-c* are used for mounting shelf 108 thereto. It should be noted that three upright supports 106*a-c* are illustrated for purposes of description. However, only the outer most upright supports 106*a*, 106*c* are needed for mounting the illustrated shelf 108. Multiple additional shelves 108 may mount to the same two upright supports 106*a*, 106*c* below shelf 108 as illustrated. Further, shelves 108 having a shorter length may be mounted between upright supports 106*a* and 106*b*, or between upright supports 106*b* and 106*c*. Unless otherwise specifically noted herein, any description of the structure, function, or use of one upright support 106*a-c* applies equally to the others. Additionally, when multipole shelves are mounted to the upright supports 106*a-c*, the shelves may be identical or different such as, for example only, different lengths, different angles, different depths, etc.

Having separate upright supports 106*a-c* provides the ability to add or remove a desired number of upright supports as discussed below to allow for a specific shelving configuration. Welded designs, such as ones having a fixed number of upright supports are also permissible in some implementations. The number of upright supports will be entirely dependent upon the shelving configuration desired. Therefore, the three upright supports 106*a-c* should be taken as only one of many possible examples. While two rails 102, 104 are shown and described, it is contemplated that only a single upper rail 102 could be utilized for receiving and supporting upright supports 106*a-c*.

While the modular system is illustrated, embodiments according to the present invention can use, cooperate with or be mounted to welded designs where the grid is a single welded assembly. Further in some embodiments, the upper and lower rails may not be required at all and only upright supports 106*a-c* may be used.

Figure 2:
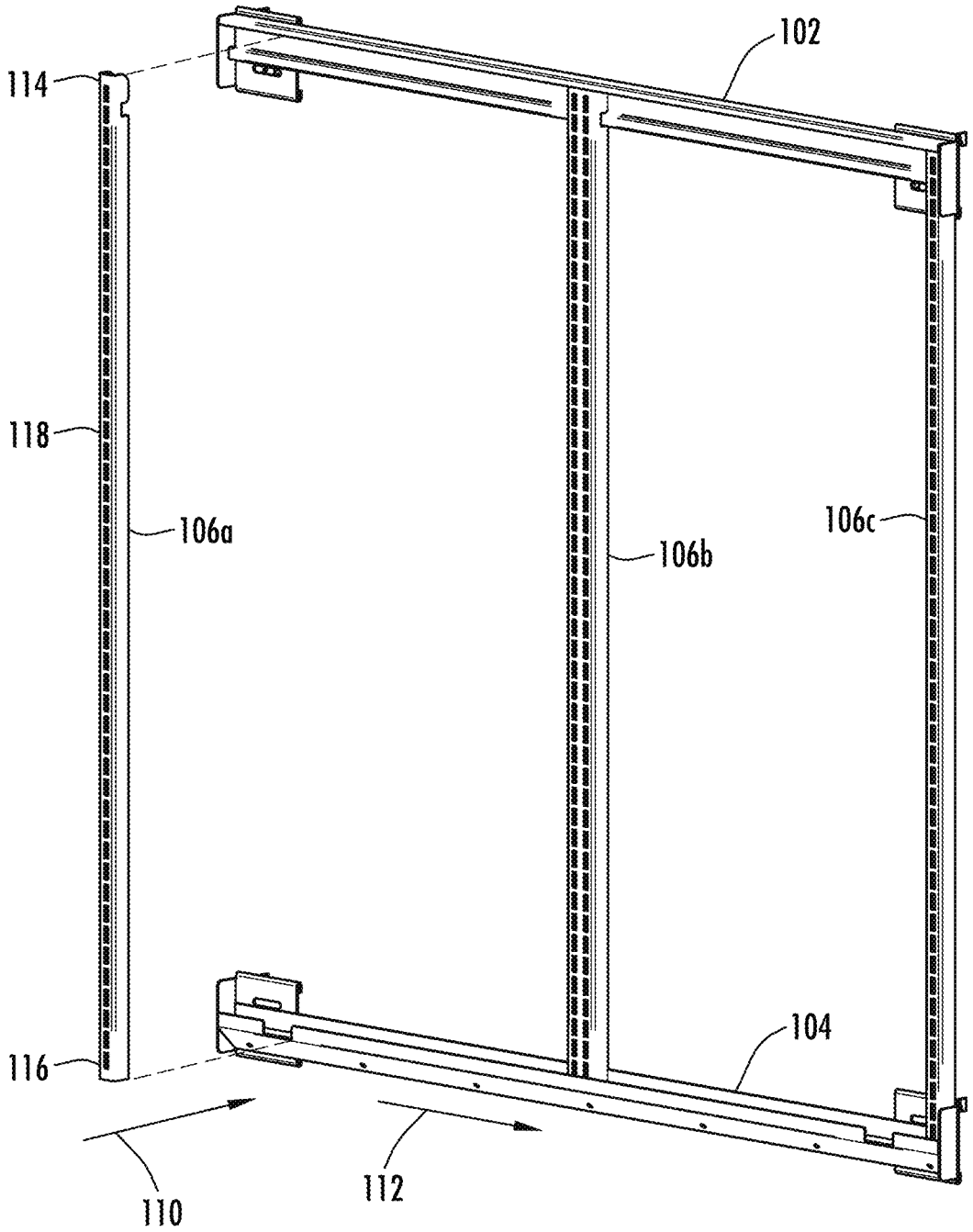
FIG. 2 is a perspective exploded view of a grid assembly of the retail shelving system of FIG. 1.

Turning now to FIG. 2, once upper and lower rails 102, 104 are installed, each upright support 106*a-c* is installed by generally situating the upright supports 106*a-c* into upper and lower rails 102, 104 by moving them generally in direction 110, and then sliding them in direction 112 to their final destinations. Upper and lower rails 102, 104 are designed such that they each include a channel within which the end portions of the upright supports 106*a-c* are situated and slidable in.

Indeed, referring specifically to upright support 106*a* shown in FIG. 2, the same includes an upper end 114 and a lower end 116. A plurality of apertures 118 are formed therein for shelf mounting. These apertures 118 may take on any shape. An identical description to that of upright support 106*a* applies to 106*c*. Upright support 106*c* differs only in that it include two parallel rows of apertures 118 as illustrated. In many situations, and as illustrated, apertures 118 may be vertically elongated.

Figure 3:
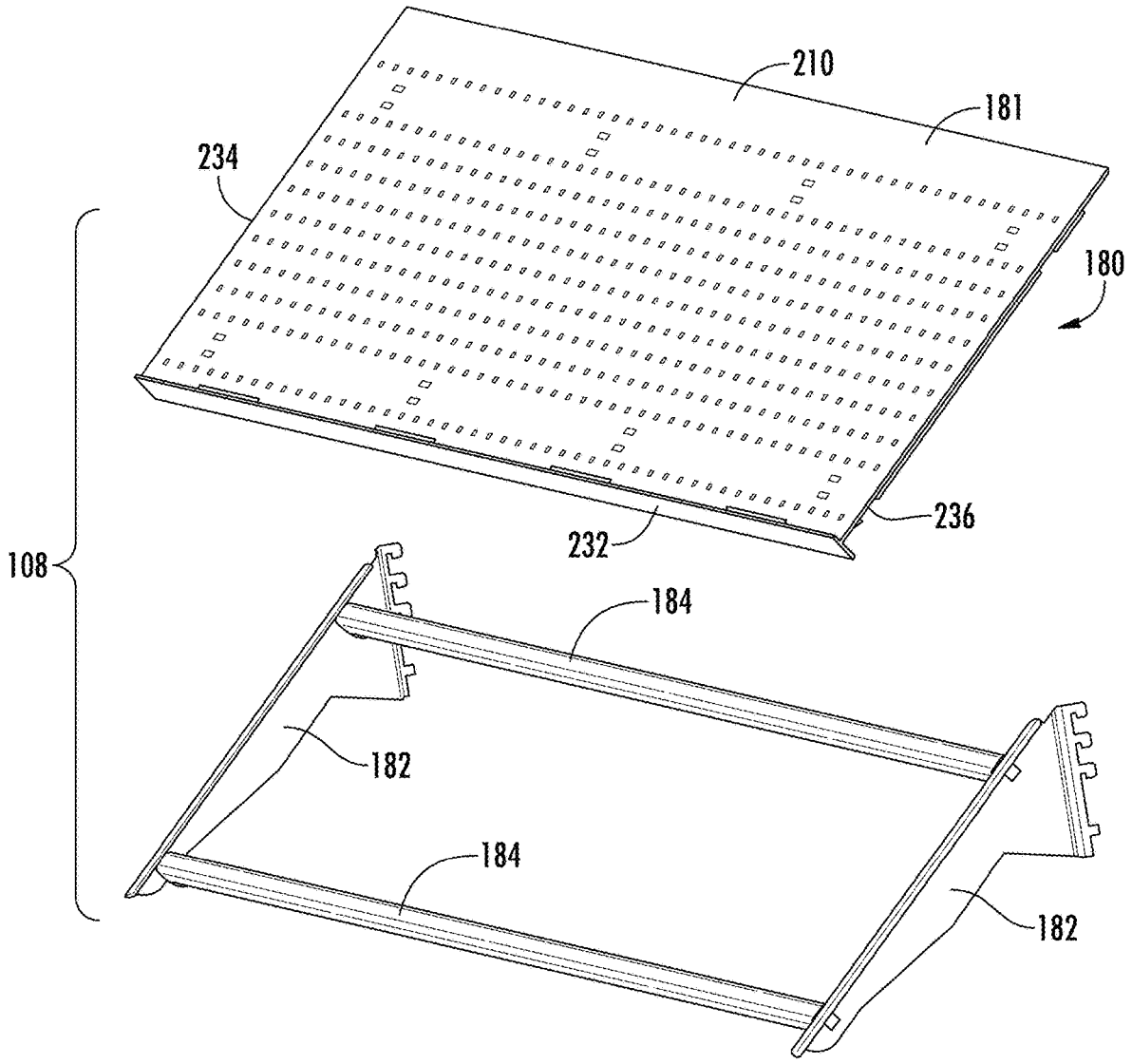
FIG. 3 is a perspective exploded view of a shelf of the retail shelving system of FIG. 1.
Figure 4:
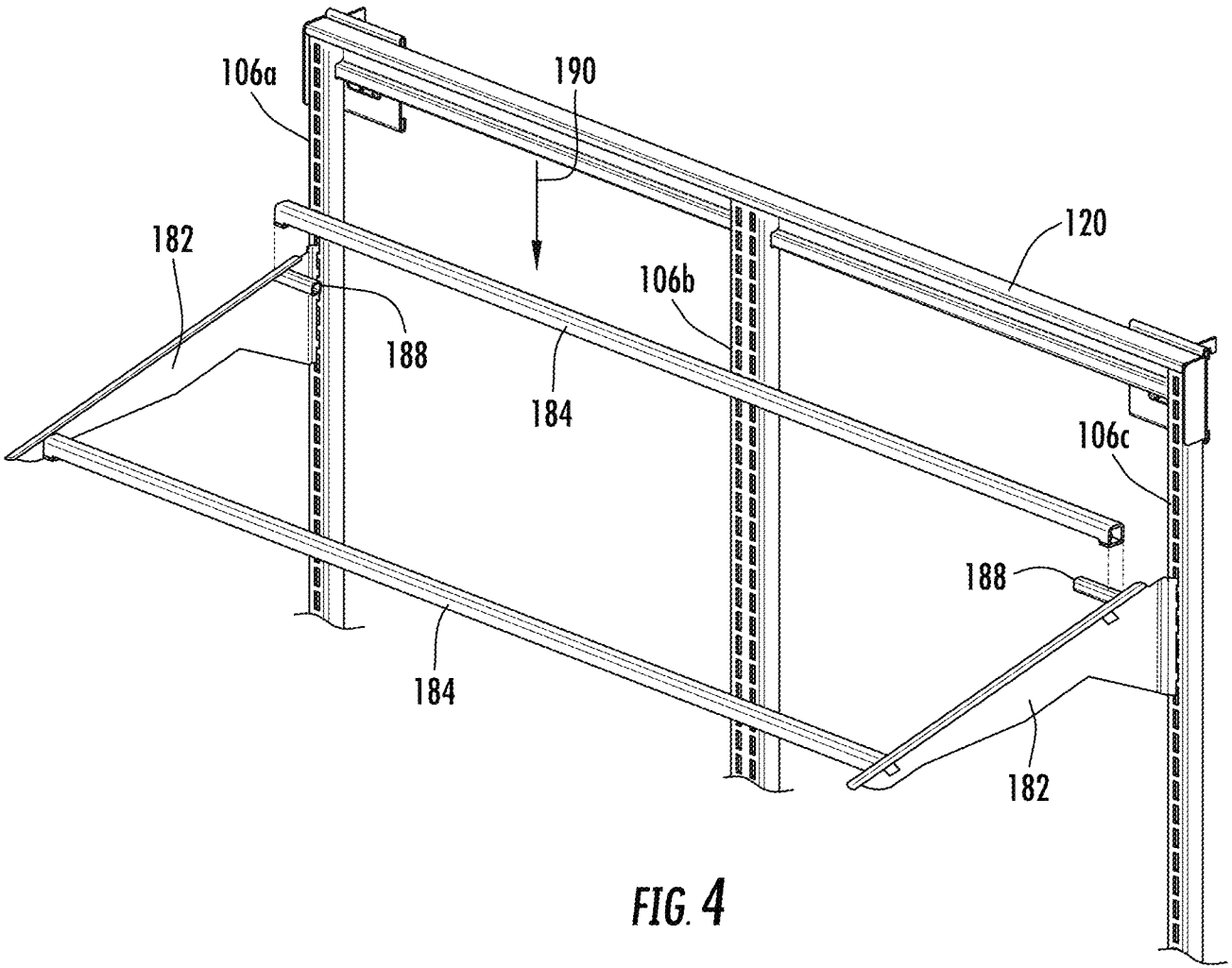
FIG. 4 is another perspective partially exploded view of the retail shelving system of FIG. 1.

Turning now to FIGS. 3-4, the same illustrate shelf 108 in greater detail. With particular reference to FIG. 3, shelf 108 includes a deck panel 180. In one embodiment, the shelves 108 have a width that is four feet measured from side edge 234 to side edge 236. However, other widths are contemplated. Although illustrated as mounting the grid assembly discussed above relative to FIGS. 1-2, it is contemplated that shelf 108 may be configured to mount to any existing structure by minor modification of the structure it utilizes for mounting. More generally, it is contemplated by the teachings herein, that the invention may be embodied as a combined system as reflected in FIG. 1 for example, or as a standalone shelf 108 that may be retrofit into an existing system.

Deck panel 180 generally includes a panel 181 that is generally planar. The panel 181 includes an upper surface 210 which is used to support merchandise. Deck panel 180 may include perforations that extend through panel 181 as shown, or any other features typical of retail shelving, e.g. features for mounting a front fence (not shown), features for mounting dividers (not shown), a price channel or price channel support 232, channels or other features for receiving and retaining lighting elements, etc. Deck panel 180 may be formed of a plastic material, for example, an acrylonitrile butadiene styrene (ABS) plastic. Such a material selection allows for the use of NSF certified materials for contacting retail items such as produce or the like.

Further, because deck panel 180 is separable and removable from the remainder of shelf 108, it may be easily cleaned in a dishwasher, sink, etc. Yet further, although not illustrated, pusher systems and other front facing devices may be readily mounted to deck panel 180.

Still referring to FIG. 3, in addition to deck panel 180, shelf 108 includes a frame that supports the deck panel. The frame generally includes first and second support arms 182 that are laterally spaced apart arranged at opposed sides of shelf 108. Support arms 182 are mirror images of one another, so a description of one applies equally well to the other. The frame of shelf 108 also generally includes front and rear support bars 184 which are also identical to one another. The front and rear support bars 184 are secured between and extend laterally between support arms 182.

Turning now to FIG. 4, shelf 108 is rapidly installable to the above described grid assembly by the following general process. First, each support arm 182 is mounted to a respective upright support 106*a-c*. In the illustrated embodiment, the left-most support arm 182 is mounted to upright support 106*a*, and the right-most support arm 182 is mounted to upright support 106*c*. Thereafter, each support bar is 184 is installed by moving the same generally in direction 190 until a support post 188 of each support arm 182 is situated within a channel of each support bar 184. Once support bars 184 are in place, deck panel 180 is then affixed to support bars 184.

Alternatively, where support bars 184 are closed profile tubular elements, it is also contemplated that each support bar 184 is installed by horizontally sliding it onto the mounting post 188 of each support arm 182. Such an operation may be done prior to installing support arms 182 onto their associated upright support. Further, although a front and rear support bar 184 are shown, it is contemplated that for deeper shelves, additional support bars 184 intermediate of front and rear support bars 184 could be utilized as well. Likewise, it is also contemplated that shallower shelf depths may only require a single support bar 184. As such, it is contemplated that at least one support bar 184 may be utilized for supporting the deck panel 180 of shelf 108.

Still further, although shelf 108 is described as mounting to two separate upright supports 106*a*, 106*c*, it is contemplated that shelf 108 may mount to a single upright support. Such a single upright support may be wider than those shown to accommodate mounting multiple support arms 182. For example, shelf 108 may mount to upright support 106*b* alone. Upright support 106*b* includes a double row of apertures 118 and can thus accommodate two support arms. The overall width of such a single upright support 106*b* may be varied to accommodate varying width shelves. As such, it is contemplated that at least one upright support is all that is required at a minimum for shelf mounting.

Figure 5:
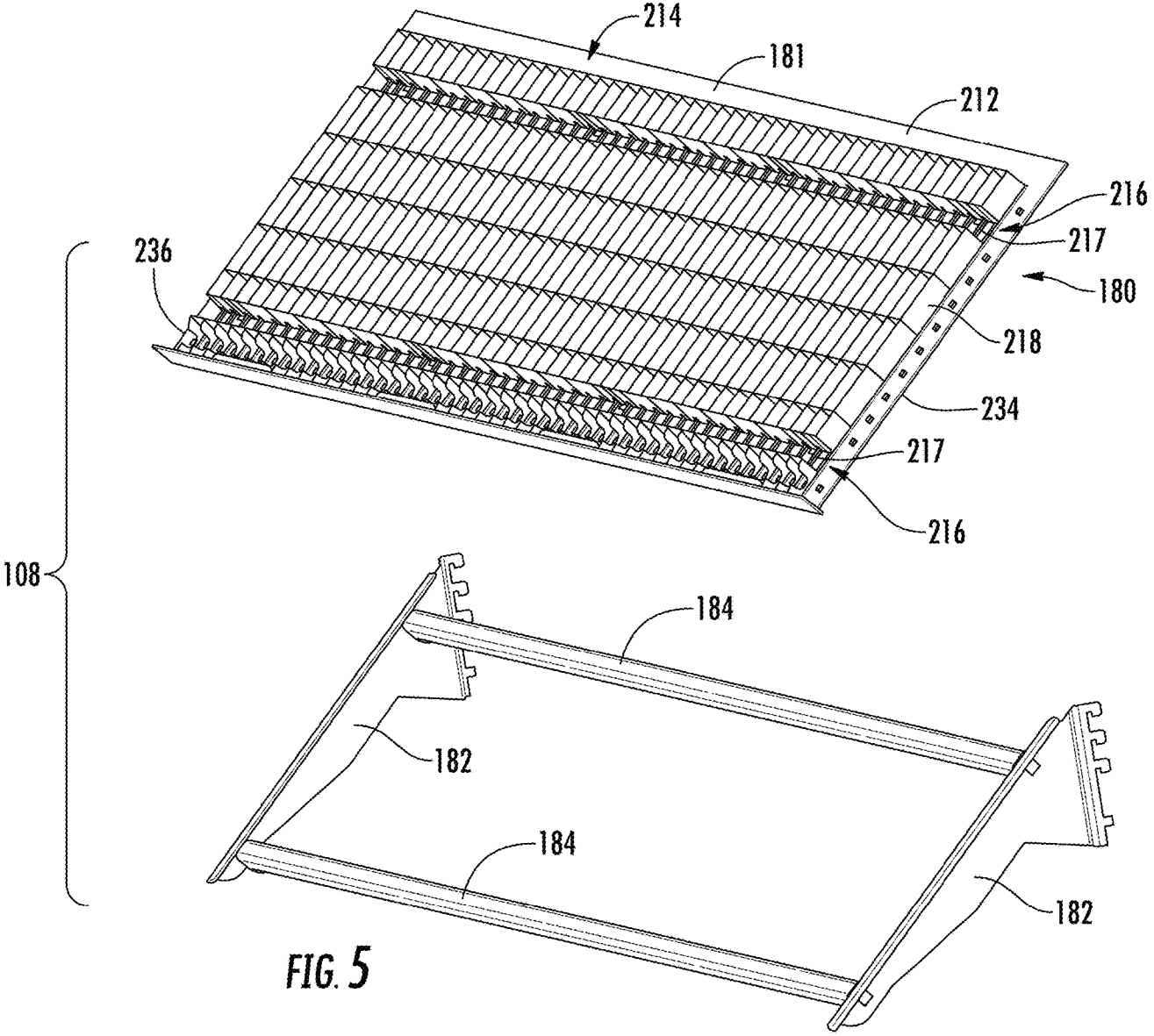
FIG. 5 is a perspective exploded view of a shelf of the retail shelving system of FIG. 1.
Figure 6:
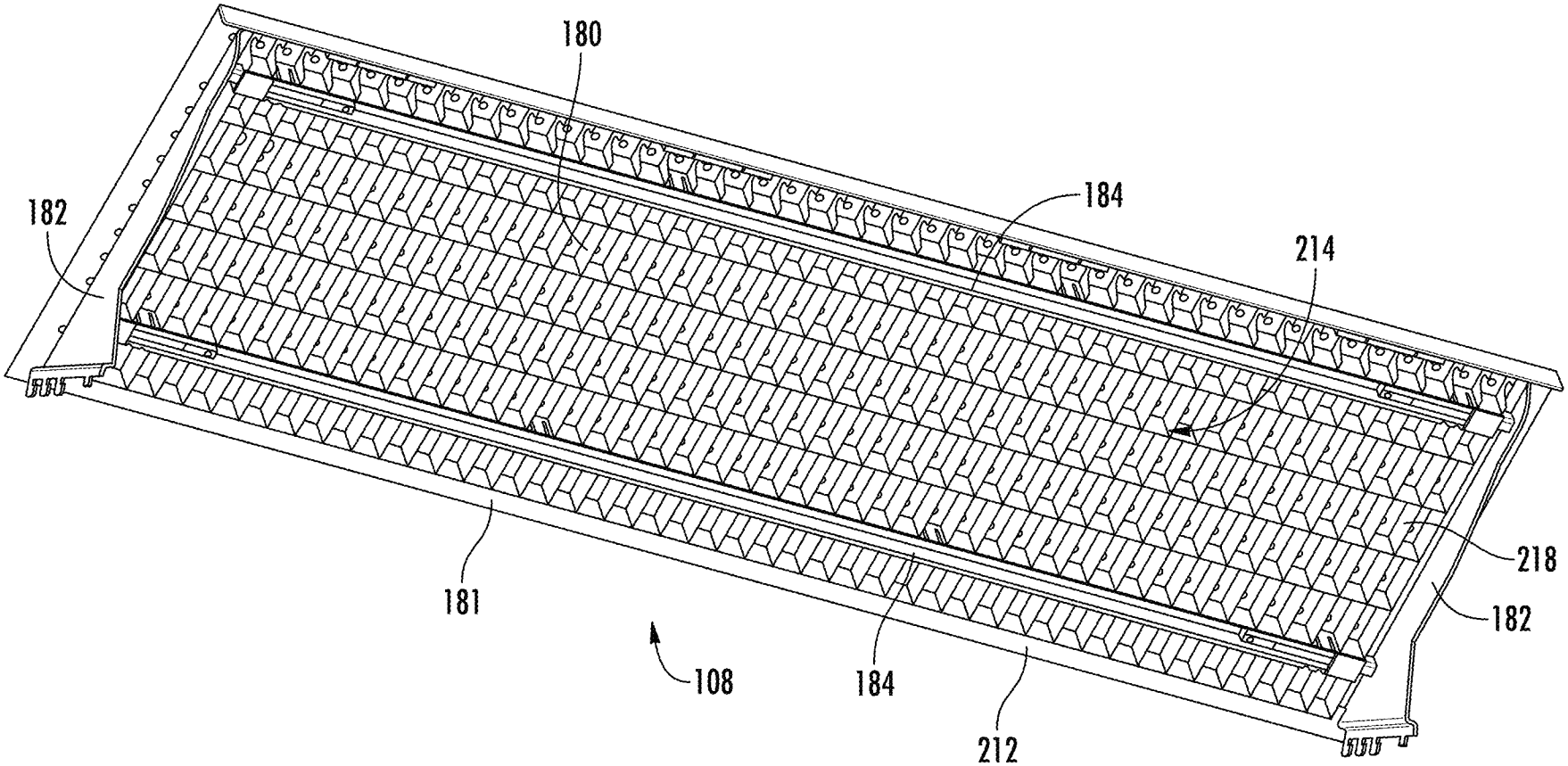
FIG. 6 is a bottom perspective view of the shelf of FIG. 5.

FIG. 5 is similar to FIG. 3, but with the deck panel 180 flipped over to illustrate the bottom side of the deck panel 181 and the bottom surface 212 of the panel 181. FIG. 6 shows the shelf 108 from a bottom side with the deck panel 180 attached to support arms 182 and support bars 184.

Figure 7:
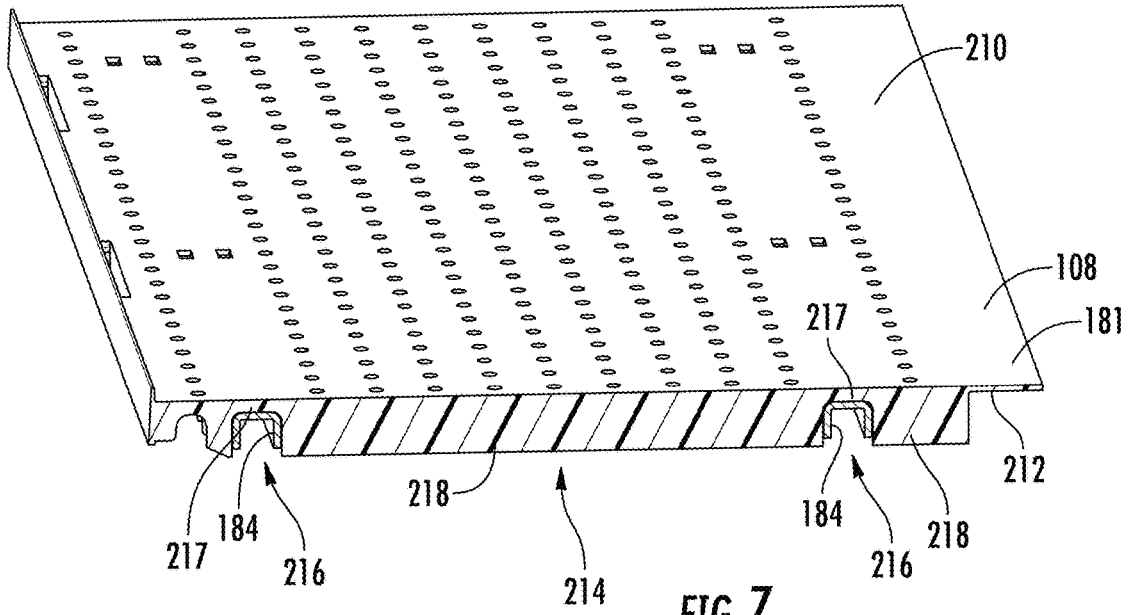
FIG. 7 is a perspective cross-sectional illustration of the shelf of FIG. 5.
Figure 12:
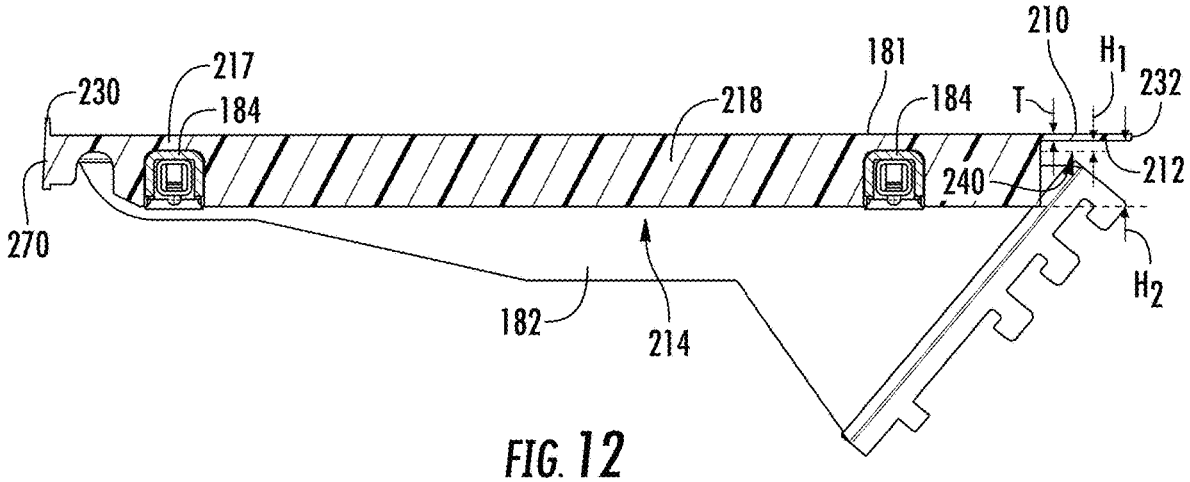
FIG. 12 is a cross-sectional illustration of the shelf of FIG. 5.
Figure 13:
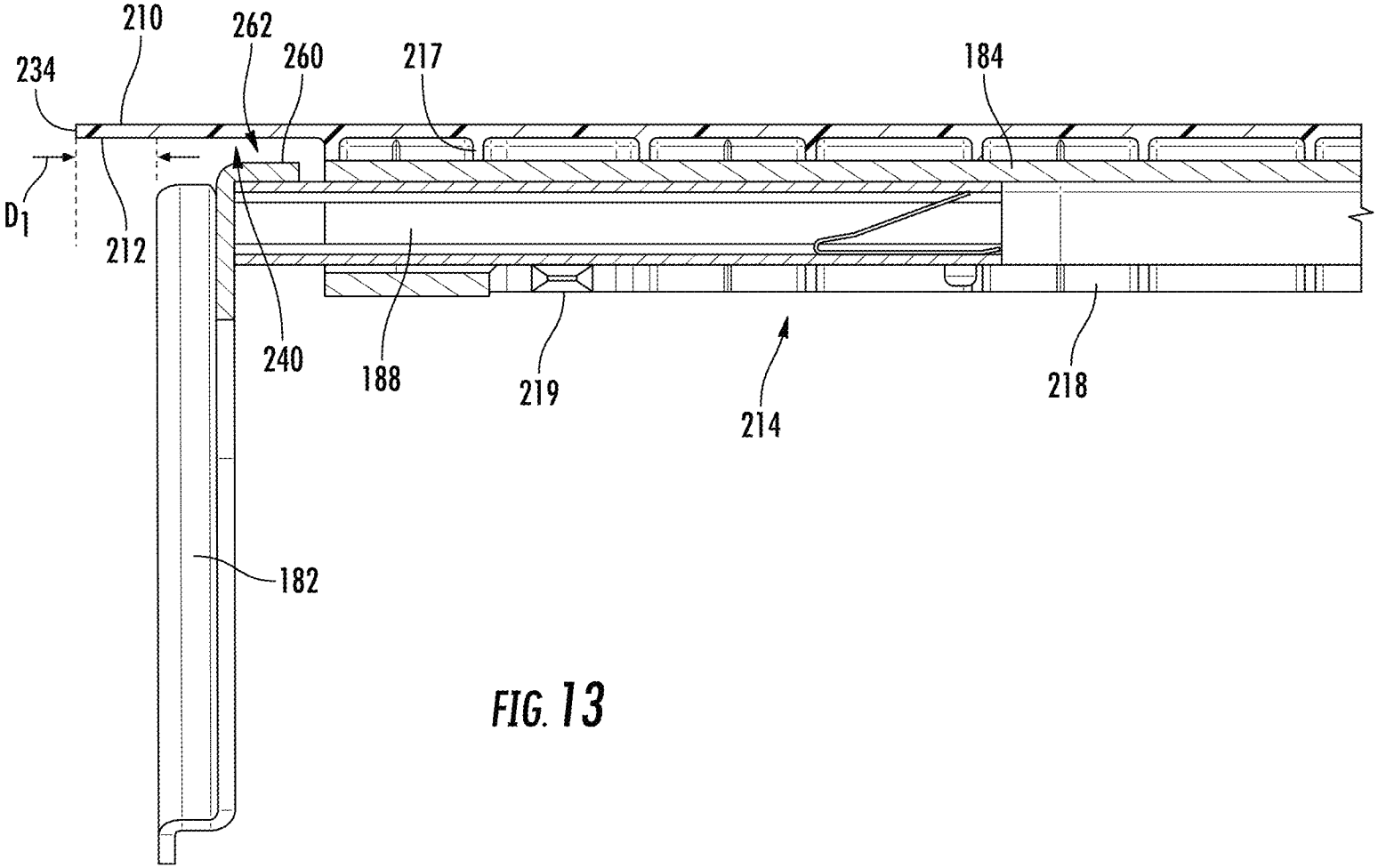
FIG. 13 is a cross-sectional illustration of the deck panel mounted to the frame structure of the shelf of the system of FIG. 1.

Deck panel 180 includes a region of strengthening ribbing 214 extending outward from bottom surface 212. A front and a rear channel 216 extends through/are formed by the region of strengthening ribbing 214. The channels 216 formed by the region of strengthening ribbing 214 receive support bars 184 therein (see e.g. FIGS. 6, 7 and 12). The bottom of the channels 216 are formed by shorter ribs 217 of the plurality of ribs forming the region of strengthening ribbing 214 (see also FIG. 13).

Figure 8:
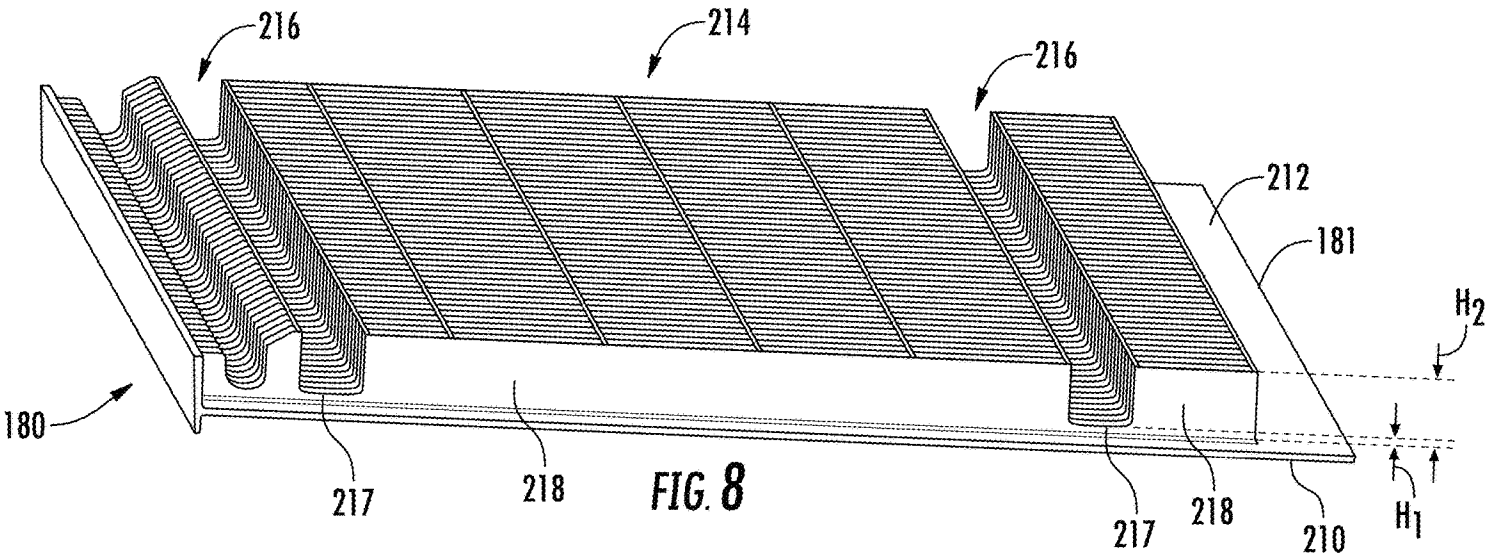
FIG. 8 is a perspective view of the deck panel of the shelf of FIG. 5.
Figure 9:
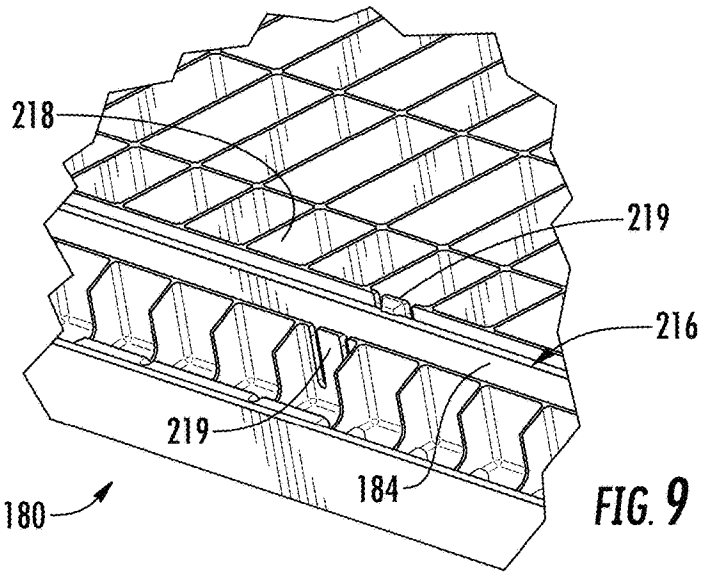
FIG. 9 is an enlarged perspective view of the deck panel of FIG. 8.

These channels 216 and shorter ribs 217 are further illustrated in FIG. 8. The short ribs 217 have a height extending from bottom surface 212 of panel 181 that is less than the height of the surrounding ribbing, which forms a majority of the ribs forming the region of strengthening ribbing 214. The height H1 of the short ribs 217 (e.g. distance extending perpendicularly from bottom surface 212) may be less than half of the height H2 of the other ribs 218 (e.g. distance extending perpendicularly from bottom surface 212), and preferably less than twenty five percent of the height of the other ribs 218.

In an example, the height H1 is about equal to the thickness T of the panel 181. In a preferred embodiment, the height H2 is at least five (5) times the thickness T of the panel 181.

Each channel 216 includes finger tabs 219 which may snap engaged with the associated support bar 184 to secure deck panel 180 to support bars 184. Although a front and rear channel 214, 216 are shown, the number of channels utilized may be varied to accommodate fewer or greater support bars 184.

Figure 10:
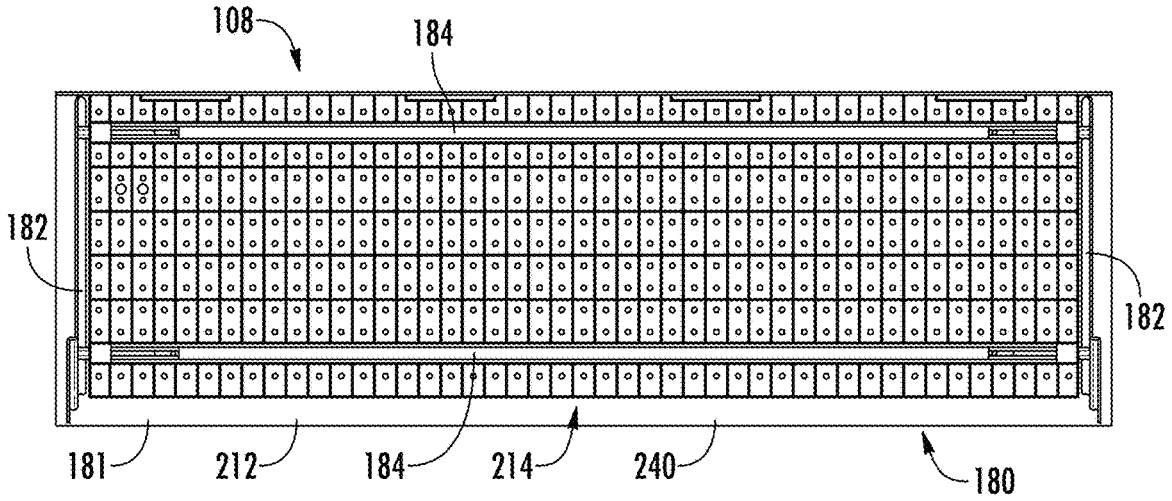
FIG. 10 is a bottom view of the shelf of the system of FIG. 1.
Figure 11:
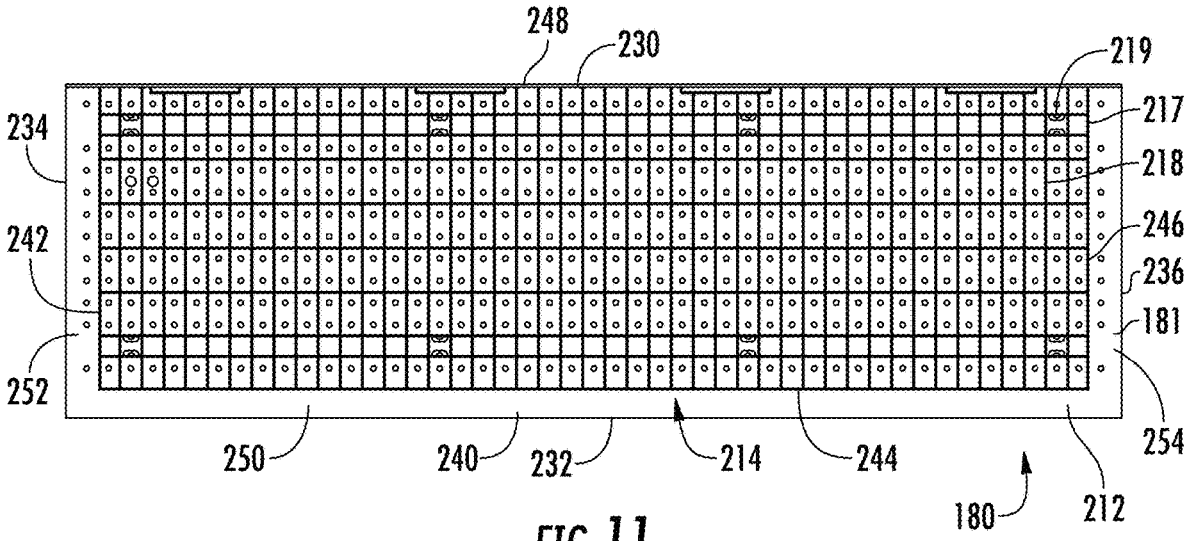
FIG. 11 is a bottom view of the deck panel of the shelf of FIG. 10.

FIG. 10 is a bottom view of the shelf 108 and FIG. 11 is a bottom view of the deck panel 180 removed from the support frame components (e.g. support arms 182 and support bars 184).

The bottom surface 212 of the panel 181 forms a border region 240 that extends around at least three sides of the region of strengthening ribbing 214.

In an embodiment, the border region 240 is substantially flat, e.g. does not include any projections or includes projections/surface ornamentation that does not have a height extending from bottom surface 212 that is more than twenty (20) percent and even more preferably no more than fifteen (15) percent the thickness of the panel 181 between the top surface 210 and bottom surface 212. In one example, the thickness of the panel is approximately two (2) millimeters while any surface ornamentation is 0.25 millimeters. This shall still be considered flat.

In this example, the panel 181 is generally rectangular and has front and rear edges 230, 232 and opposed laterally spaced apart side edges 234, 236. The region of strengthening ribbing 214 has a generally rectangular periphery and has opposed sides 242, 246 that are laterally spaced apart and front side 248 and rear side 244. The front side 248 generally corresponds to front edge 230. The rear side 244 is generally parallel to and spaced inward from rear edge 232. Opposed sides 242, 246 are generally parallel to and spaced inward from side edges 234, 236.

In the illustrated example, a rear portion 250 of the border region 240 extend along and between the rear edge 232 of panel 181 and rear side 244 of the region of strengthening ribbing 214 is free of any projections at all and is free of any apertures therethrough.

However, side portions 252, 254 of the border region 240 that extend along and between the side edges 234, 236 of panel 181 and sides 242, 246 of the region of strengthening ribbing 214 includes apertures spaced outward from the sides 242, 246.

In an example, the side portions 252, 254 extend laterally outward beyond the corresponding support arms 182. This illustrated in FIG. 13, where the side edge 234 is spaced a distance D1 from the laterally outer most portion of support arm 182.

Further, in an example, the bottom surface 212 and particularly the border region 240 thereof is vertically spaced from the top surface 260 of the support arms 182, forming a gap 262 therebetween.

In the illustrated example, the front edge 230 is provided by a vertical wall 270. This vertical wall may be used to attach labels or label holders. The vertical wall 270 extends upward beyond the top surface 210 and downward beyond the bottom surface 212. The ribs 218 of the region of strengthening ribbing 214 connect with the bottom portion of vertical wall 270.

The upper portion of vertical wall 270, e.g. the portion that extends upward of the top surface 210 may be used as a front stop to prevent merchandise from sliding off of the deck panel 180.

In a preferred example, the apertures that extend through panel 181 do not align with any of the ribs 217, 218 such that a rib extends across an aperture. This reduces debris from being trapped within the apertures.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelf comprising:

a first and a second support arm arranged in opposed lateral spaced relation to one another;

a front support bar extending laterally between the first and second support arms;

a rear support bar extending laterally between the first and second support arms; and a deck panel supported by the front and rear support bars, the deck panel comprising:

a panel having a top surface configured for supporting retail merchandise and a bottom surface;

a region of strengthening ribbing including a plurality of ribs extending outward from the bottom surface of the panel; and the bottom surface having a border region that extends around the region of strengthening ribbing on at least three sides, the border region being substantially flat;

the border region extending over the first and second support arms, the region of strengthening ribbing being positioned laterally between the first and second support arms.

2. The shelf claim 1, wherein the panel has a front edge, a rear edge and a pair of side edges extending between the front edge and the rear edge, the border region extending along the pair of side edges and the rear edge.

3. The shelf of claim 2, wherein:

the border region has a thickness measured perpendicular to the bottom surface;

the plurality of ribs extending outward from the bottom surface having an average height that is measured perpendicular to the bottom surface, the average height being at least five times the thickness.

4. The shelf of claim 1, wherein the border region is free of projections.

5. The shelf of claim 1, wherein the border region includes apertures extending entirely through a thickness of the border region.

6. A deck panel for a retail shelving system, the deck panel comprising:

a panel having a top surface configured for supporting retail merchandise and a bottom surface;

a region of strengthening ribbing including a plurality of ribs extending outward from the bottom surface of the panel; and the bottom surface having a border region that extends around the region of strengthening ribbing on at least three sides, the border region being substantially flat;

wherein the panel has a front edge, a rear edge and a pair of side edges extending between the front edge and the rear edge, the border region extending along the pair of side edges and the rear edge wherein:

the border region has a thickness measured perpendicular to the bottom surface;

the plurality of ribs extending outward from the bottom surface having an average height that is measured perpendicular to the bottom surface, the average height being at least five times the thickness the front edge is provided by a vertical wall that extends outward beyond the top surface and outward beyond the bottom surface.

7. The deck panel of claim 6, wherein a plurality of the plurality of ribs are all interconnected with one another and interconnected with the vertical wall.

8. The deck panel of claim 6, wherein a first portion of the border region extends between the vertical wall and the rear edge along one of the pair of side edges, a second portion of the border region extends between the pair of side edges along the rear edge, a third portion of the border region extends between the vertical wall and the rear edge along the other one of the pair of side edges.

9. The deck panel of claim 6, wherein the border region is free of projections.

10. The deck panel of claim 6, wherein the panel has a generally rectangular periphery.

11. The deck panel of claim 6, wherein the region of strengthening ribbing has an outer periphery that includes pair of opposed sides and a rear side, the opposed sides being generally parallel, the rear side being generally perpendicular to the sides of the pair of opposed sides; the pair of opposed sides being generally parallel to and spaced inward from the pair side edges and the rear side being generally parallel to and spaced inward from the rear edge.

12. The shelf of claim 2 wherein the border region is free of projections or apertures in the portion thereof extending along the rear edge.

13. The deck panel of claim 6, wherein the panel includes a plurality of apertures extending through the top and bottom surfaces, wherein the ribs do not extend across any of the apertures such that the ribs do not have a portion of an aperture on one side of the rib and a portion of the same aperture on the other side of the rib.

14. The shelf of claim 1, wherein the border region extends laterally outward beyond the first and second support arms.

15. The shelf of claim 1, wherein the region of strengthening ribbing includes a front channel and a rear channel, the front support bar being received in the front channel and the rear support bar being received in the rear channel.

16. The shelf of claim 15, wherein for each of the front and rear channels, a bottom thereof is defined by short rib regions, the short rib regions being shorter than the plurality of ribs, the top of the front and rear support bars abutting the short rib regions.

17. The shelf of claim 16, wherein each of the first and second support arms has a top surface, the border region being vertically spaced from the top surface of the first and second support arms.

18. The shelf of claim 1, wherein the shelf includes a single deck panel supported by the first and second support arms and the front and rear support bars.

19. The shelf of claim 1, wherein the deck panel includes resilient finger tabs that snap engage the deck panel to at least one of the front and rear support bars.

20. A shelving system comprising:

a shelf according to claim 1; and a pair of upright supports, each upright support having an upper end and a lower end, each upright support having a plurality of apertures mounting the first and second support arms thereto.

21. A shelf comprising:

a first and a second support arm arranged in opposed lateral spaced relation to one another;

a front support bar extending laterally between the first and second support arms;

a rear support bar extending laterally between the first and second support arms; and a deck panel supported by the front and rear support bars, the deck panel comprising:

a panel having a top surface configured for supporting retail merchandise and a bottom surface;

a region of strengthening ribbing including a plurality of ribs extending outward from the bottom surface of the panel;

the bottom surface having a border region that extends around the region of strengthening ribbing on at least three sides, the border region extending over the first and second support arms, the region of strengthening ribbing being positioned laterally between the first and second support arms.

* * * * *